US007661625B2

(12) United States Patent
Rieger et al.

(10) Patent No.: US 7,661,625 B2
(45) Date of Patent: Feb. 16, 2010

(54) JETTISONABLE NOSECONE AND MISSILE WITH A JETTISONABLE NOSECONE

(75) Inventors: Gerald Rieger, Lauf (DE); Roland Waschke, Daisendorf (DE); Gerd Elsner, Oberuhldingen (DE); Klaus Tondok, Hohenfels (DE); Peter Gerd Fisch, Überlingen (DE)

(73) Assignee: Diehl BGT Defence GmbH & Co., K.G., Überlingen (DE)

( * ) Notice: Subject to any disclaimer, the term of this patent is extended or adjusted under 35 U.S.C. 154(b) by 324 days.

(21) Appl. No.: 11/438,825

(22) Filed: May 23, 2006

(65) Prior Publication Data

US 2007/0074636 A1 Apr. 5, 2007

(30) Foreign Application Priority Data

Jun. 27, 2005 (DE) ..... 10 2005 030 090

(51) Int. Cl.
*F42B 15/36* (2006.01)
*F42B 15/10* (2006.01)

(52) U.S. Cl. ..... 244/121; 102/378; 89/1.14

(58) Field of Classification Search ..... 244/122 AF, 244/171.7, 173.1, 158.1, 3.23, 3.24, 3.25, 244/3.26, 121, 172.6; 102/374, 377, 378; 24/603; 89/36.17, 1.14; 411/390, 391, 20
See application file for complete search history.

(56) References Cited

U.S. PATENT DOCUMENTS

| | | | | |
|---|---|---|---|---|
| 3,070,018 | A * | 12/1962 | Fahl | 102/378 |
| 3,362,290 | A * | 1/1968 | Carr et al. | 89/1.14 |
| 3,453,960 | A | 7/1969 | Qualls | |
| 3,706,281 | A * | 12/1972 | Hatakeyama | 102/378 |
| 6,601,886 | B1 * | 8/2003 | Thayer | 188/375 |
| 2005/0000383 | A1 * | 1/2005 | Facciano et al. | 102/377 |
| 2006/0010769 | A1 | 1/2006 | Pelz | |

FOREIGN PATENT DOCUMENTS

| | | |
|---|---|---|
| DE | 101 27 483 A1 | 6/2001 |
| DE | 101 27 483 A1 | 12/2002 |
| EP | 1 319 920 B1 | 6/2003 |

* cited by examiner

*Primary Examiner*—Michael R Mansen
*Assistant Examiner*—Richard R Green
(74) *Attorney, Agent, or Firm*—Scully, Scott, Murphy & Presser, P.C.

(57) ABSTRACT

A jettisonable nosecone (10) for a missile is specified, which nosecone (10) is longitudinally split into at least two parts (15, 16) and is held together by detachable connecting structures, in which case the connecting structures are designed to actively move the at least two parts (15, 16) away from one another when released. A missile having a correspondingly designed nosecone (10) is also provided. A nosecone (10) of this type allows simple jettisoning during every flight phase of the missile, and is also suitable for retrofitting to an already existing missile.

7 Claims, 7 Drawing Sheets

JETTISONABLE NOSECONE AND MISSILE WITH A JETTISONABLE NOSECONE

BACKGROUND OF THE INVENTION

1. Field of the Invention

The invention relates to a jettisonable nosecone for a missile, which nosecone is longitudinally split into at least two parts and is held together by detachable connecting means. The invention also relates to a missile having a jettisonable nosecone of this type.

Missiles make use of jettisonable nosecones in order, for example, to protect the sensitive seeker optics, in particular the radiation-permeable dome, against external influences such as foreign object strikes or heat during a flight to the point of operation. Nosecones generally impede the view of the sensitive seeker system and can thus be used only in relatively predetermined flight phases or in flight phases in which the missile is not being guided to the target by means of the seeker system. When the missile is intended to be guided to the target by the seeker system, the nosecone must be jettisoned in order to allow unimpeded target acquisition.

2. Discussion of the Prior Art

Jettisonable nosecones are known, for example, from CH 525 798, DE 102 11 493 B3 and DE 196 35 851C2. CH 525 798 describes a nosecone which is composed of a prestressed material, in particular prestressed glass. An operating mechanism in the missile is operated pyrotechnically for jettisoning, so that a tip strikes against the edge of the nosecone. In consequence, the nosecone is broken up into a large number of small particles.

DE 196 35 851 C2 discloses a jettisonable nosecone which is held on the missile by means of holding elements which are arranged in grooves and are sprung radially inwards. For jettisoning, these holding elements are deflected outwards by means of unlocking cylinders, and thus disengaged from the missile.

The unlocking cylinders can be operated by a gas generator that can be initiated, by a gas spring or pyrotechnically.

DE 102 11 493 B3 discloses a jettisonable nosecone for a missile, which nosecone is held on the guided missile by means of a hinged joint and a tear-off attachment. For jettisoning, an explosive charge is initiated, as a result of which the tear-off attachment is torn open, and the nosecone pivots about the movement axis of the hinged joint. On reaching a defined pivoting angle, the nosecone is automatically separated from the missile.

A nosecone and a missile of the type mentioned initially are known from DE 102 40 040 A1. This document proposes that the nosecone be designed such that it is split into at least two parts in the longitudinal direction, with the two parts being held together by detachable connecting means. When the connecting means are operated or released, then the at least two parts open outwards in the form of a "beak" by virtue of the ram-air pressure in the interior of the nosecone, and are thus torn away from their anchorage on the missile. In order to produce the ram-air pressure within the nosecone, it can be provided with an opening at the nose.

According to CH 525 798, the operating mechanism which is required to jettison the nosecone must be incorporated in the missile. This is disadvantageous for retrofitting of an existing missile. The spreading-open or pivoting mechanism which are described in DE 196 35 851 C2 and DE 102 11 493 B3 for integral jettisoning of the nosecone disadvantageously do not overcome the risk of the jettisoned nosecone colliding with the guided missile. Finally, the nosecone according to DE 102 40 040 A1, which opens in the form of a "beak" disadvantageously cannot be jettisoned if the ram-air pressure required for opening cannot be achieved, for example during a slow flight phase.

One object of the invention is to specify a jettisonable nosecone for a missile, which can easily be retrofitted and can easily be separated from the missile in any missile flight phase. A further object of the invention is to specify a missile having a nosecone designed in this way, in which case the missile and the nosecone can easily be separated from one another in any flight phase. The first-mentioned object is achieved according to the invention for a jettisonable nosecone for a missile, which nosecone is longitudinally split into at least two parts and is held together by detachable connecting means, in that the connecting means are designed to actively move the at least two parts away from one another when released.

A first step of the invention is in this case based on the idea that a longitudinally split nosecone can be jettisoned more easily than an integral or laterally-split nosecone. This is because the longitudinal splitting allows the individual parts of the nosecone to move past the missile at the sides. The individual parts just need to be moved away from one another for this purpose.

In a further step, the invention is based on the idea that safe and simple jettisoning of the parts of a longitudinally split nosecone is achieved if the individual parts can be moved away from one another independently of the respective flight phase of the missile. This is the case when the connecting means which hold the parts of the longitudinally split nosecone together are designed such that the individual parts can move, away from one another actively when released.

In other words, the invention provides for the individual parts of a longitudinally split nosecone, upon release of the connecting means holding them together, to be actively moved away from one another by the latter. The longitudinal splitting thus results in the individual parts of the nosecone being forced radially outwards with respect to the missile longitudinal axis. The individual parts of the nosecone move past the missile at the sides.

Provided that a missile does not carry out any rolling movement, a nosecone which is longitudinally spilt into two parts can be mounted on the missile in such a way that its joint gap is aligned vertically during flight of the missile. This offers the advantage that, on jettisoning, the two parts of the nosecone can always move past the missile at the sides even during descending or climbing flight. There is no risk of a missile which is climbing or descending colliding with a part of a nosecone which has been jettisoned upwards or downwards. If the joint gap is aligned essentially vertically, the effective incidence angle of the parts of the nosecone, which depends on the incidence angle of the missile with respect to the incident flow, is minimized. This minimizes the risk of parts of the nosecone colliding with the missile.

Since the detachable connecting means are arranged in the nosecone, already existing missiles can easily be retrofitted with a nosecone such as this. Since the parts of the nosecone move away from one another actively, the nosecone can be safely jettisoned at both low and high missile speeds of flight. The initiation of the connecting means which hold the parts together can be activated on a time-controlled basis at any time via the electronics in the missile. A remote initiation is also possible.

A metal or a plastic may be used as the material for the nosecone. In particular, sheet steel may be used as the metal. The plastic may, if required, be reinforced or sheathed with carbon or glass fibres.

Fundamentally widely different techniques may be used to actively move the at least two parts of the nosecone away from one another. A gas spring, an explosive charge or a gas generator, in particular, may be used. It is also feasible for the parts of the nosecone to be held together in a mechanically prestressed form, so that, when the connecting means are released, the stored mechanical energy is converted to kinetic energy in the parts that are flying away from one another.

The connecting means advantageously comprise a connecting pin which can be activated pyrotechnically and has a hole into which a propellant charge is inserted, with gases being released on initiation of the propellant charge, driving at least two parts away from one another. The propellant charge, which releases large amounts of energy within a short time, is in this case integrated directly in the connecting pin which holds the parts of the nosecone together. The gases which are released spontaneously on initiation of the propellant charge are used to drive the parts of the nosecone away from one another. The integration of the propellant charge in the connecting pin allows the rate of initiation to be matched to the respective external parameters, which are governed by the missile or by the operating conditions. This can be achieved, for example, by the choice of material for the connecting pin, or by the composition of the propellant charge.

In one advantageous embodiment of the invention, the at least two parts of the nosecone are held together by means of the connecting pin via hollow cylinders which can be plugged axially into one another and form an internal cavity, with the hole in the connecting pin having an opening to the internal cavity, via which the gases which are released on initiation of the propellant charge and drive the hollow cylinders axially away from one another flow into the internal cavity. In other words, the at least two parts are plugged into one another via hollow cylinders in the form of a piston. The gases which flow into the internal cavity via the opening on initiation of the propellant charge force the two hollow cylinders away from one another, so that the parts of the nosecone are moved away from one another. During this movement away from one another, the connecting pin is torn in two. The movement of the parts of the nosecone away from one another can be adapted in accordance with the operating conditions and for an existing missile type by means of the configuration or the number of openings introduced, as well as the shape and size of the internal cavity. If the joint gap is aligned vertically, driving the hollow cylinders away from one another axially means that they are driven away from one another in the lateral direction with respect to the missile longitudinal axis.

In a further advantageous embodiment, the at least two parts are held together directly by means of the connecting pin, with the hole extending in the longitudinal direction and, in addition to the propellant charge, having a piston which fits into it, and in which case the piston can be driven in the longitudinal direction by initiation of the propellant charge. In this embodiment, the connecting pin which holds the two parts together directly produces a pulse which is directed outwards or in the longitudinal direction of the connecting pin, as a result of which the parts of the nosecone are moved away from one another. When the propellant charge in the hole which is aligned to the longitudinal direction is initiated, then the gases drive the piston which is fitted into this hole forwards in the longitudinal direction, as a result of which the connecting pin is torn apart. The two parts of the connecting pin accordingly have an opposite impulse. In this embodiment, the parts of the nosecone just need to be designed such that they can be connected to one another via the connecting pin. This can be achieved, for example, by the parts each having openings which are incorporated in a web and being held together via these openings by means of the connecting pin, which is in the form of a screw or rivet. This technique also allows the nosecone to be fitted easily to the missile.

The connecting pin advantageously has a weak point. The weak point ensures that the connecting pin is torn apart at a predetermined point on initiation of the propellant charge. If the connecting pin is provided with a piston which is fitted into it, it is worthwhile forming the weak point essentially laterally with respect to the longitudinal direction of the connecting pin, so that the impulse of the piston, which is driven forwards by initiation of the propellant charge in the longitudinal direction, acts on the weak point.

In another advantageous refinement, the nosecone is conical, in the form of an ogive, or is paraboloid. Other streamlined nosecone shapes which, for example, have better aerodynamics than a hemispherical shape, are also feasible. These shapes have good aerodynamics and thus help to reduce the drag on the missile. For missiles which have a hemispherical dome because of the need to have a wide observation angle, a nosecone which has such a good aerodynamic design allows the range to be improved. The nosecone thus acts as aerodynamic cladding and reduces the aerodynamic drag of the basic configuration of the missile without the nosecone. Even in the situation where an air-to-air missile with a dome shape that has not been optimized with regard to the aerodynamics in favor of the observation angle is intended to be launched from the ground, an aerodynamically well-designed nosecone offers the capability to achieve the range that is achieved when fired from an aircraft even when fired from the ground.

For jettisoning of the nosecone, it is advantageous for it to be possible to connect the nosecone to the missile by means of a convex groove at the end. If the impulse for actively moving the parts of the nosecone away from one another is transmitted in the front area of the nosecone, then this refinement allows the parts of the nosecone to be tilted radially away from the missile via this convex groove.

In order to attach the nosecone securely to the missile, it is advantageous if, an angled groove for guidance of a pin which is arranged on the missile is introduced on the internal circumference of the nosecone for bracing with respect to the missile. In this case, it is particularly advantageous for two such grooves which are offset through 180° to be incorporated in the circumference of the nosecone, along which the corresponding pins which project out of the structure of the missile are guided. In this case, an additional attachment capability can be created simply by rotation of the nosecone with respect to the missile. The angled groove and the pin which is arranged on the missile thus form a so-called "bayonet fitting".

In the situation with a combination of a convex groove incorporated at the end together with the angled groove that is intended to hold a pin which projects out of the structure of the missile, the nosecone can be fitted to and removed from the missile by first of all pushing it axially onto a collar which is arranged on the circumference of the missile. During this process, the convex groove at the end of the nosecone engages with a concave groove which is fitted to the collar and points forwards. At the same time, the pin or pins which is or are fitted to the missile engages or engage in the corresponding angled grooves which are incorporated on the internal circumference of the nosecone. Slight rotation of the nosecone then results in it being braced between the pins and the collar on the missile. The circumferential collar also provides an axial supporting function during acceleration of the missile.

The second-mentioned object with regard to a missile is achieved according to the invention by the missile having a jettisonable nosecone as described above.

Advantageously, as described in this case, the nosecone engages at the end in a raised collar which runs in the circumferential direction on the missile. In this case, it has been found in particular that it is sufficient for attachment of the nosecone and for jettisoning of its parts for the raised collar to be interrupted in places in the circumferential direction. The interruption can in this case also be designed generously.

BRIEF DESCRIPTION OF THE DRAWINGS

Exemplary embodiments of the invention are explained in more detail in the drawing, in which.

DETAILED DESCRIPTION OF THE INVENTION

Figure 1:
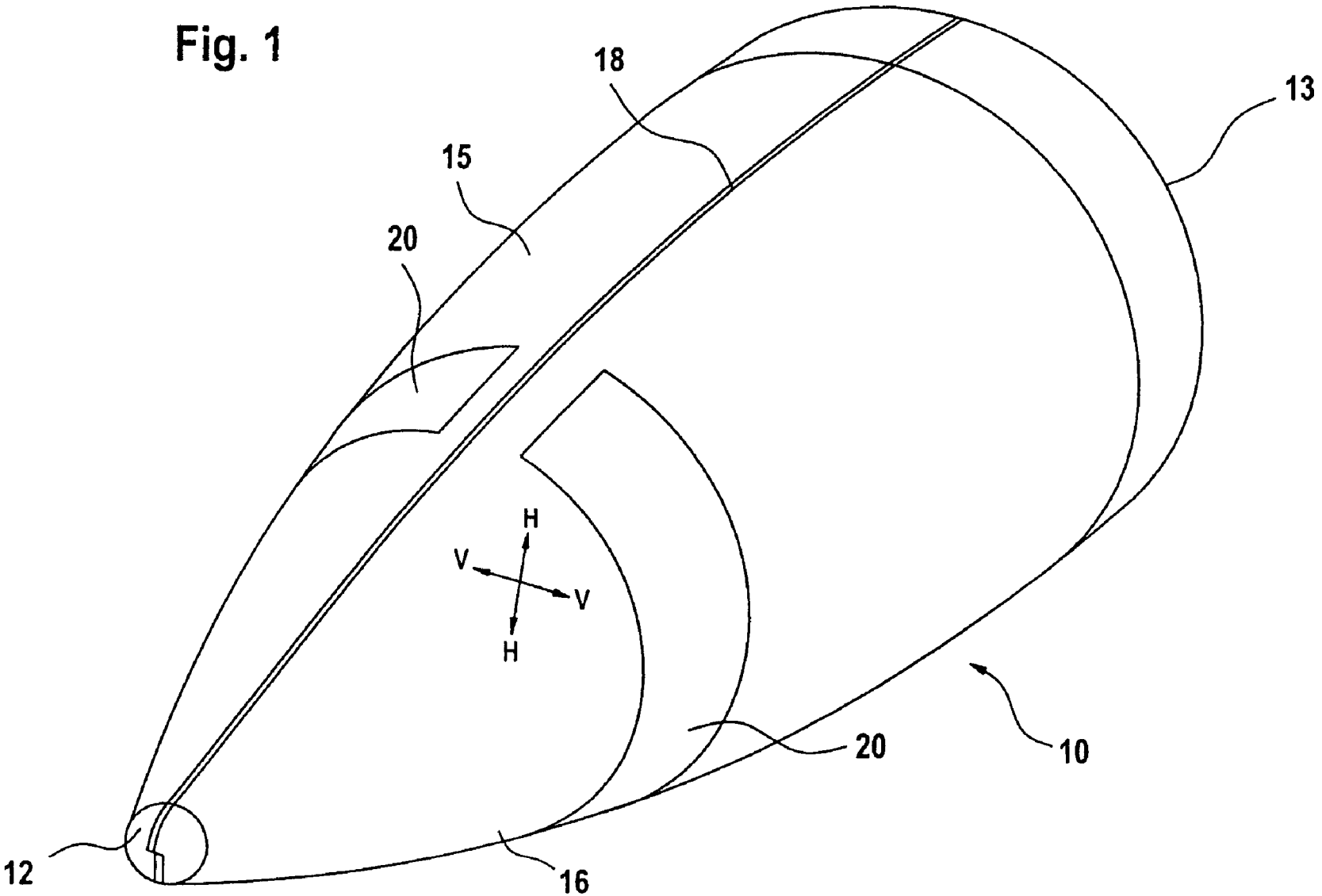
FIG. 1 shows a perspective illustration of a nosecone which is longitudinally split into two halves.

FIG. 1 shows a perspective illustration of a jettisonable nosecone 10, which is split in two in the longitudinal direction, for a missile. The nosecone 10 extends from a nose 12 to an end 13. The figure clearly shows the two parts 15, 16 which are fitted to one another via a joint gap 18 which runs in the longitudinal direction of the nosecone 10. The nosecone 10 has two covers 20 which are partially circumferential around the external circumference and are removable in order to make it possible to fit the two parts 15, 16 to one another.

Figure 2:
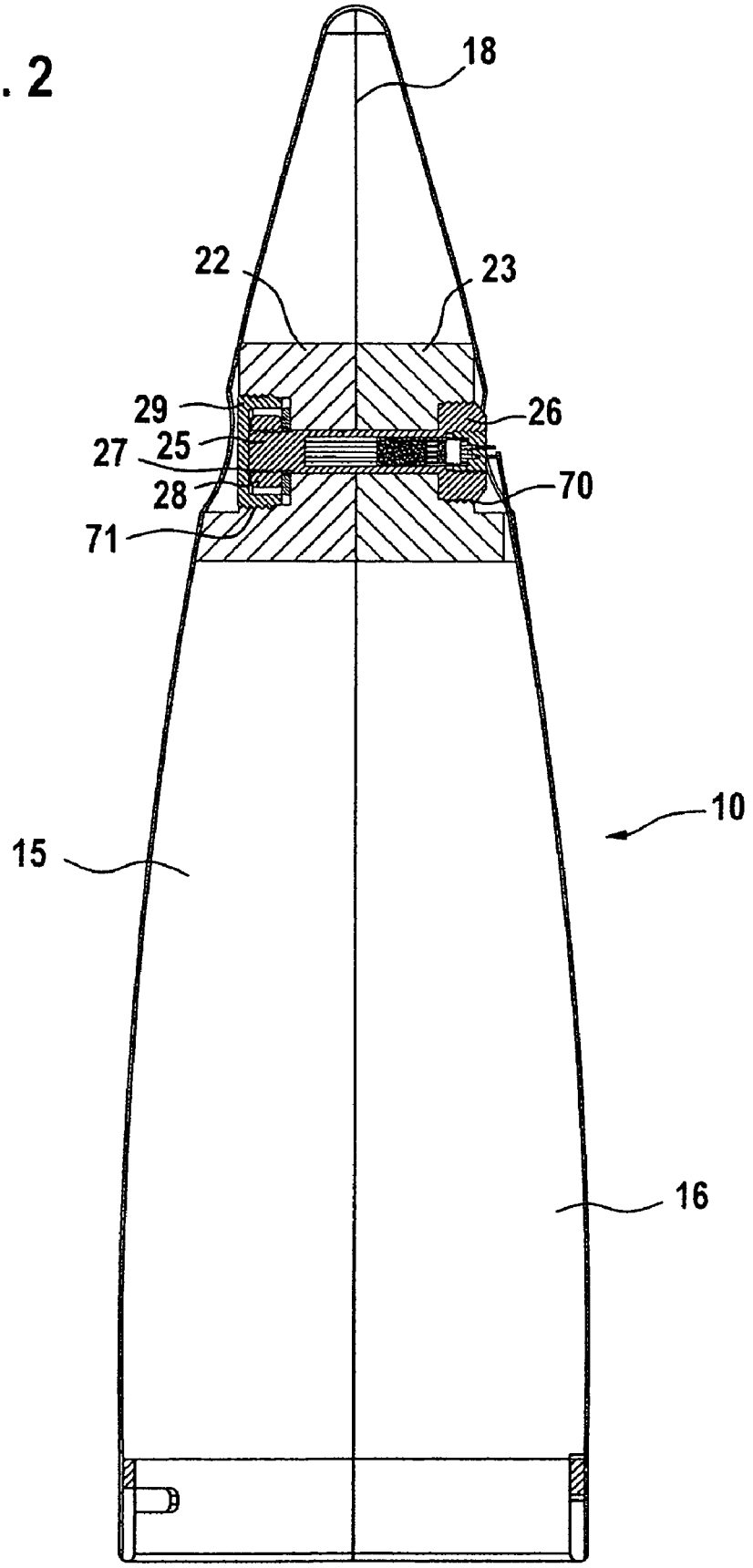
FIG. 2 shows a section through a nosecone as shown in FIG. 1, looking at a connecting pin which holds the two halves together.

FIG. 2 shows a section through a nosecone 10 designed as shown in FIG. 1. The figure shows the two parts 15, 16 as well as the joint gap 18, which runs in the longitudinal direction. The webs 22, 23 which are provided for connection of the two parts 15, 16 can likewise clearly be seen. The two halves 15, 16 are held together by means of a connecting pin 25, via a hole which is incorporated in each of the webs 22 and 23. For this purpose, the connecting pin 25 is in the form of a screw with a screwhead 26 and a thread 27. The two parts 15, 16 of the nosecone 10 can easily be connected to one another, using a suitable tool, by means of a nut 28 which is fitted to the thread 27. Furthermore, the part 15 is firmly connected to the connecting pin 25 via a closure piece 29, which is screwed in by means of the external thread 71, for impulse transmission when the connecting pin 25 is initiated. The screwhead 26 is likewise screwed by means of an external thread 70 into the part 16. The connecting pin 25 may also be in the form of a connecting bolt.

Figure 3:
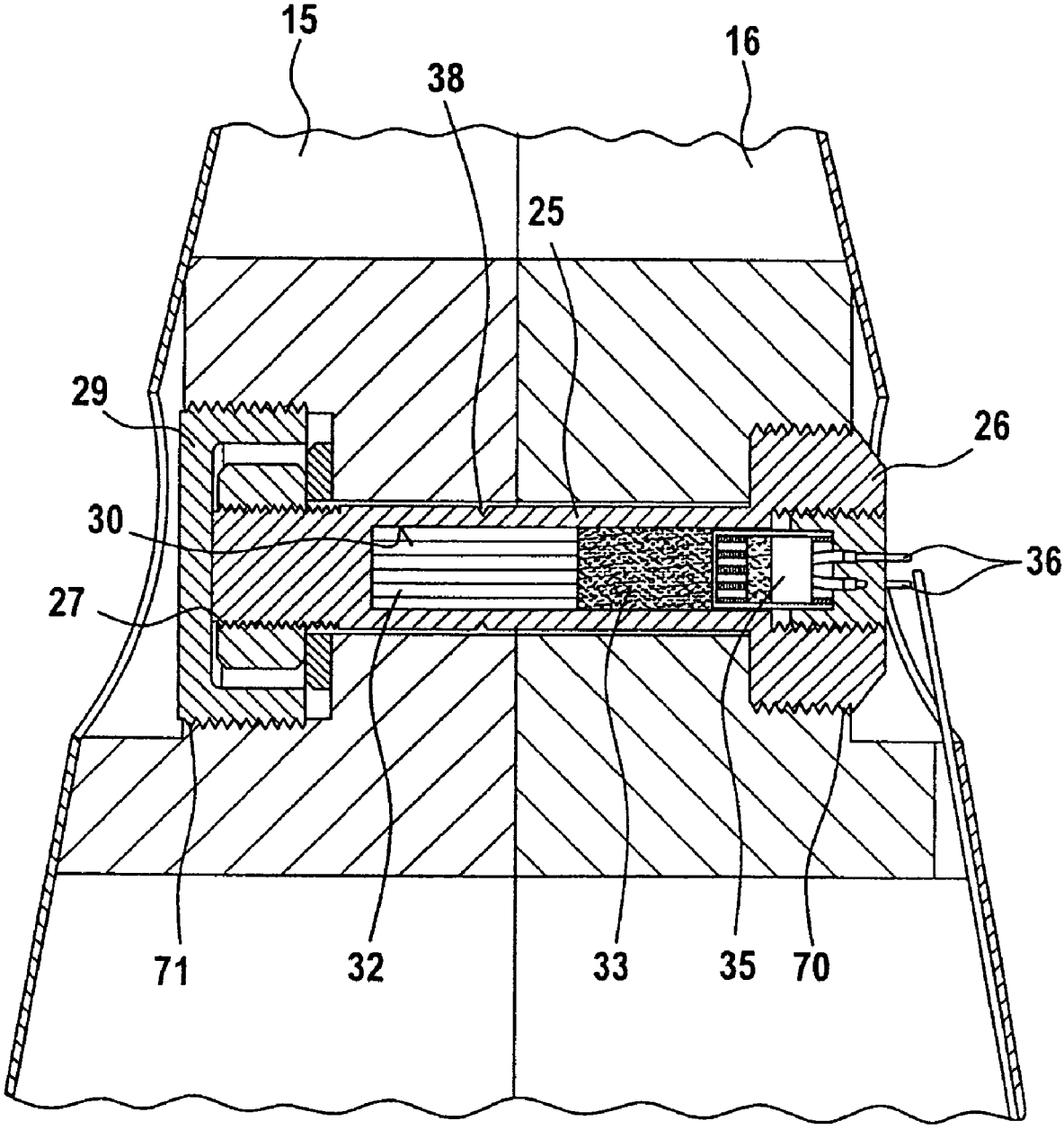
FIG. 3 shows an enlarged detail from FIG. 2.

The connecting pin 25 which holds the two parts 15, 16 of the nosecone 10 together as shown in FIG. 2 is shown in detail in FIG. 3. The connecting pin 25 has the screwhead 26 which can, in fact, be seen in FIG. 2, and has the thread 27, which is likewise in fact illustrated in FIG. 2, at the other end. A hole 30 which extends in the longitudinal direction is incorporated in the interior of the connecting pin 25. A piston 32 and a propellant charge 33 are introduced into this hole. An. initiation pellet 35, which can be initiated via connecting wires 36 routed on the outside is located in front of the propellant charge 33 in the interior of the connecting pin 25. The connecting pin 25 has a weak point 38 in the form of a circumferential groove in the center. When the propellant charge 33 is initiated by means of the initiation pellet 35, then gases develop explosively in the hole 30 and drive the piston 32 forwards, away from the screwhead 26. The forward impulse of the piston 32 and the opposite impulse produced by the reaction on the connecting pin 25 tears the connecting pin apart at the weak point 38. The two connecting parts are driven away from one another in opposite directions as a consequence of the forward impulse of the piston 32, which acts on the piece of the connecting pin 25 that is provided with the thread 27, and the opposite reaction impulse, which acts on the piece of the connecting pin 25 provided with the screwhead 26. This impulse is transmitted to the parts 15, 16 of the nosecone 10 which are held together by this connecting pin 25, as shown in FIG. 2. For attachment, the closure piece 62 is in this case connected by the external thread 71, and the screwhead 26 is connected by the external thread 70 to the respective parts 15 and 16.

FIG. 4 once again shows a perspective illustration of the inside of a part 15 of the longitudinally split nosecone 10 as shown in FIG. 1 or 2. The web 22 can clearly be seen in this case, via which the part 15 is connected to the other part 16 of the nosecone 10. A hole 38 is incorporated in the web 22 for this purpose. At the end, the part 15 has a circumferential convex groove 40, which is intended to engage in a concave groove, which is incorporated in a corresponding manner on the missile. An angled groove 42 is incorporated on the internal circumference approximately at the center of the circumference of the part 15. This angled groove 42 is used to guide a pin which projects out of the contour of the missile. In order to fit the nosecone, it is pushed on axially, with the corresponding pin first of all being guided along the groove 42 in the axial direction. The nosecone can then be braced in the form of a bayonet fitting by rotation with respect to the missile, during which process the corresponding pin 52 is guided in that part of the groove 42 which is angled in the circumferential direction of the part 15.

Figure 4:
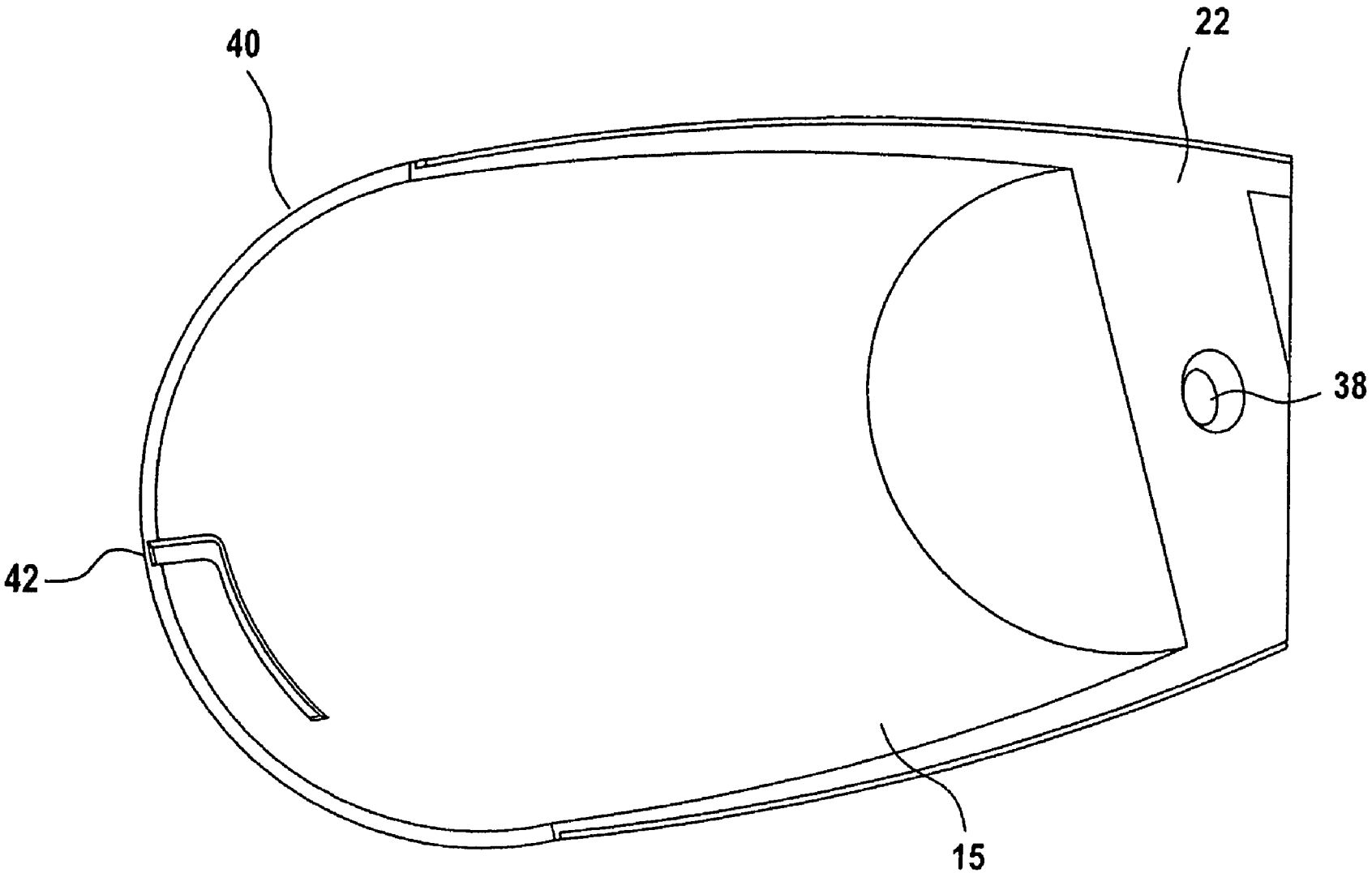
FIG. 4 shows a perspective illustration of the internal wall of one of the two halves of the nosecone shown in FIG. 1.
Figure 5:
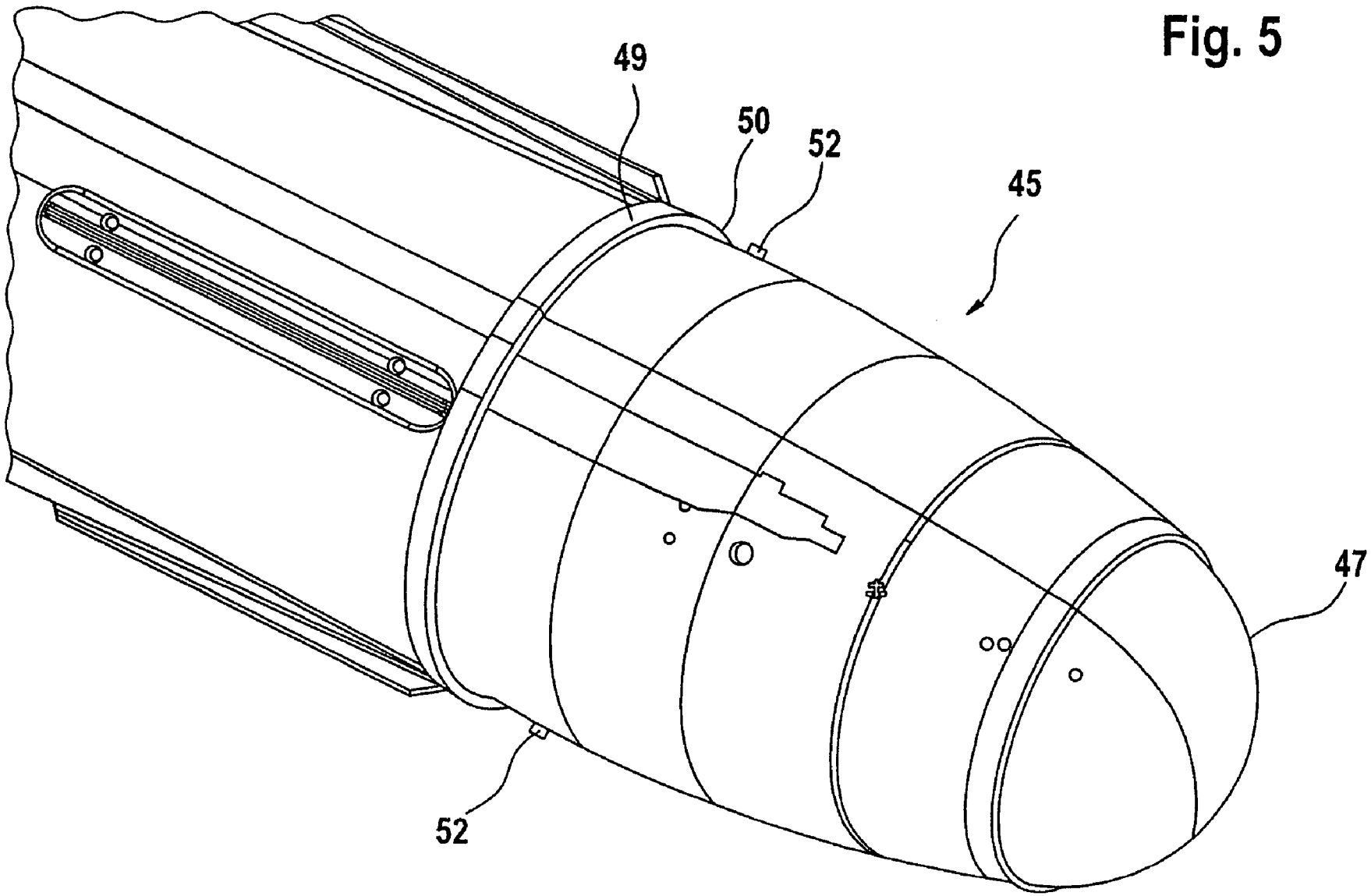
FIG. 5 shows a perspective illustration of the nose of a missile which is designed to hold the nosecone.

FIG. 5 shows, in perspective form, the nose 45 of a missile which has been prepared to hold a nosecone 10 as shown in FIG. 1 or 2. A hemispherical dome 47 composed of a material which is permeable for IR radiation is arranged on the nose 45 of the missile. An IR seeker head which is mounted on universal joints and scans a wide spatial angle range looking for target signatures, is located behind the dome 47. In order to hold the nosecone 10, the nose 45 of the missile has a circumferential collar 49, at whose end which points forwards towards the dome a circumferential concave groove 50 is incorporated. Two pins 52 which project out of the contour of the missile are also fitted, offset through 180°, on the circumference of the nose 45 and engage in the angled groove 42, as illustrated in FIG. 4, in the respective parts 15, 16 of the nosecone 10. A foam body can be inserted between the dome 47 and the nosecone, in order to protect the dome 47.

Figure 6:
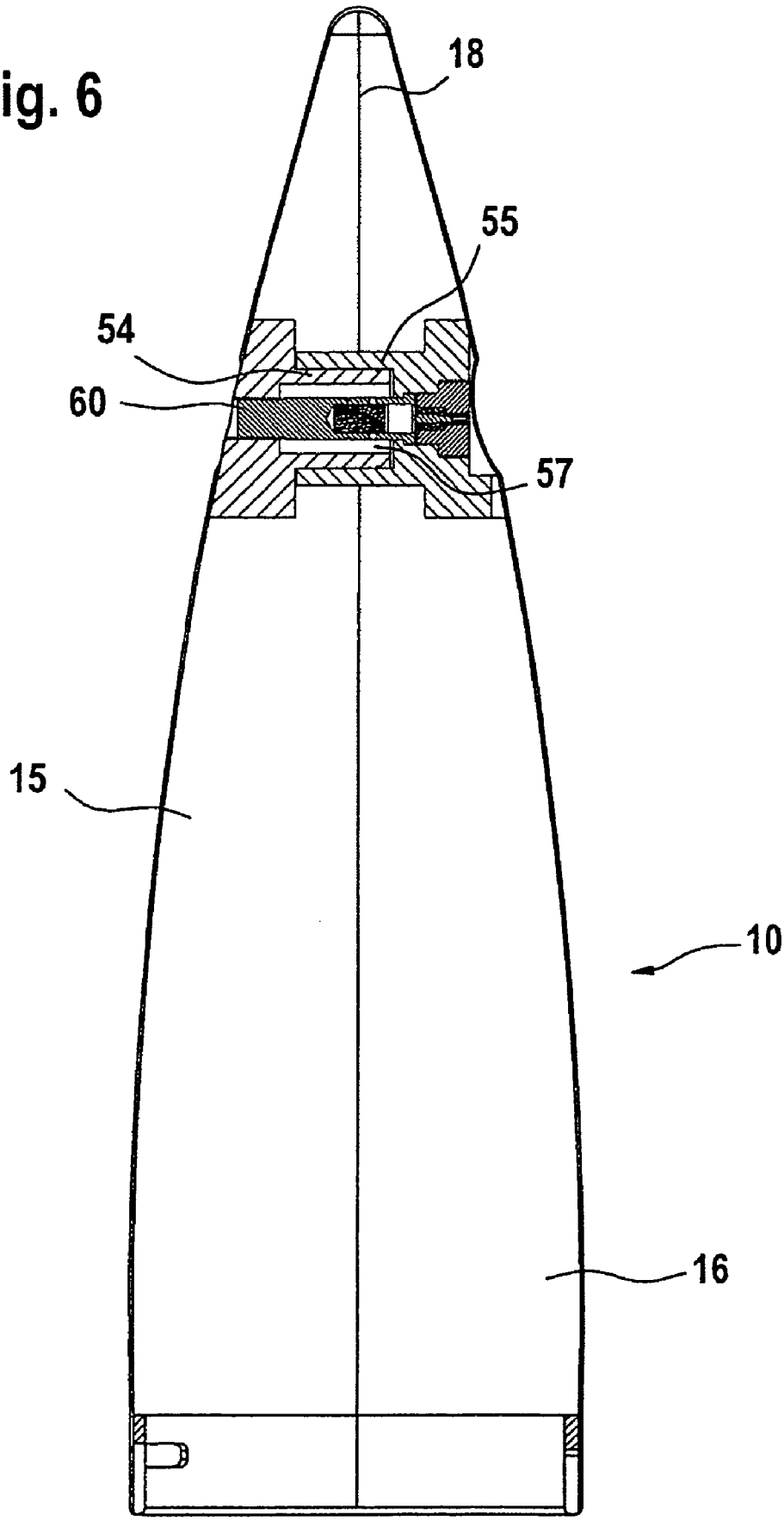
FIG. 6 shows a section through a nosecone as shown in FIG. 1, with the connection of the two halves being in the form of hollow cylinders which can be plugged into one another.

FIG. 6 once again shows a section through a nosecone 10 designed in a corresponding manner to FIG. 1. The two parts 15, 16 and the joint gap 18 which runs in the longitudinal direction can be seen. The two parts 15 and 16 are in this case connected to one another via hollow cylinders 54, 55 which can be plugged into one another. The hollow cylinders are in this case held together via a connecting pin 60. In order to move the two parts 15 and 16 away from one another actively, the two hollow cylinders form an internal cavity 57 in the interior, into which the gases that are released expand when the connecting pin 60 is released.

Figure 7:
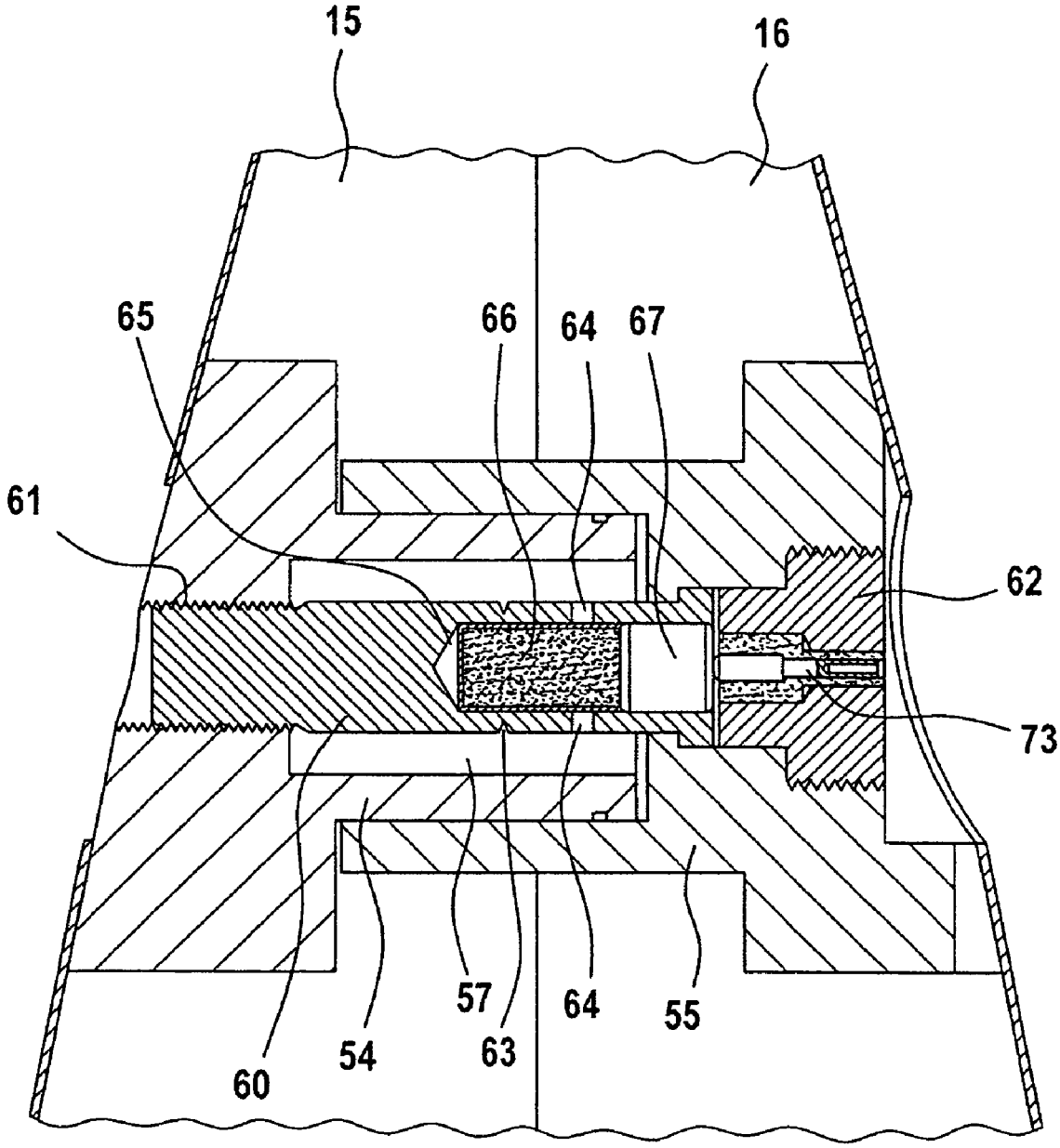
FIG. 7 shows an enlarged detail from FIG. 6.

In this context, FIG. 7 shows the connection of the two halves 15, 16 via the hollow cylinders 54 and 55, which can be plugged into one another, in detail. In this case, a first hollow cylinder 54 of the part 15 engages in a second hollow cylinder 55 of the part 16. The hollow cylinders 54, 55 can be moved into one another. The internal cavity 57 which is created by the hollow cylinders 54, 55 being plugged into one another can clearly be seen. The two parts 15, 16 of the nosecone 10 are held together via a connecting pin 60, for which purpose the latter has a thread 61. A connecting piece 62 is screwed into the part 16 at the head end of the connecting pin 60. In the internal cavity 57, the connecting pin 60 has a weak point 63 in the form of a circumferential groove. The connecting pin 60 also has two openings 64, which open into the internal cavity 57. A hole 65 is incorporated in the interior of the connecting pin 60, and is completely filled with a propellant charge 66.

The propellant charge 66 can be initiated via an initiation pellet 67 which is introduced in the closure piece 62, for which purpose the initiation pellet 67 has a contact 73 for transmission of an initiation pulse.

When the propellant charge 66 in the connecting pin 60 is initiated via the initiation pellet 67, the gases which are created escape via the two openings 64 into the internal cavity 57. At the same time, the weak point 63 is torn apart. The two hollow cylinders 54, 55 are moved away from one another as a result of further expansion in the internal cavity 57. The two parts 15, 16 of the nosecone are actively driven away from one another.

| List of reference symbols | |
|---|---|
| 10 | Nosecone |
| 12 | Tip |
| 13 | End |
| 15, 16 | Parts |
| 18 | Joint gap |
| 20 | Covers |
| 22, 23 | Web |
| 25 | Connecting pin |
| 26 | Screwhead |
| 27 | Thread |
| 28 | Nut |
| 30 | Hole |
| 32 | Piston |
| 33 | Propellant charge |
| 35 | Initiation pellet |
| 36 | Connecting wires |
| 38 | Weak point |
| 40 | Convex groove |
| 42 | Angled groove |
| 45 | Nose of the missile |
| 47 | Dome |
| 49 | Collar |
| 50 | Concave groove |
| 52 | Pins |
| 54 | First hollow cylinder |
| 55 | Second hollow cylinder |
| 57 | Internal cavity |
| 60 | Connecting pin |
| 61 | Thread |
| 62 | Closure piece |
| 63 | Weak point |
| 64 | Opening |
| 65 | Hole |

-continued

| List of reference symbols | |
|---|---|
| 66 | Propellant charge |
| 67 | Initiation pellet |
| 68 | Connecting wires |

What is claimed is:

1. A jettisonable nosecone for a missile, said nosecone being longitudinally split into at least two separate parts (15, 16), and detachable connecting means for holding together said at least two separate parts (15, 16), the connecting means being releasable for actively moving the at least two separate parts (15, 16) away from one another, said connecting means comprising a connecting pin (60) which is pyrotechnically activatable, said connecting pin (60) including a hole (65), a propellent charge (66), being arranged in said hole to enable gases to be released on initiation of the propellent charge (66) for driving said at least two parts (15, 16) away from one another, said connecting pin (60) having a weak point (63) in the central portion thereof facilitating rupture of said connecting pin responsive to initiation of said propellent charge (66), said at least two separate parts (15, 16) being held together by the connecting pin (60) threadinaly engaging hollow cylinders (54, 55) which are axially slideably inserted into one another and form an internal cavity (57) extending about a central portion of said connecting pin (60), opposite outer ends of said hollow cylinders (54, 56) contacting inner surface portions of, respectively, said at least two separate parts (15, 16) the hole (65) in the connecting pin (60) including at least one opening (64) communicating with the internal cavity (57), via which the gases which are released on initiation of the propellent charge (66) and which drive the hollow cylinders (54, 55) axially away from one another upon rupture of said connecting pin, flow into and expand within the internal cavity (57) for causing said hollow cylinders to force said at least two separate parts (15, 16) apart from each other.

2. A jettisonable nosecone according to claim 1, wherein the nosecone is selectively conical, in the form of an ogive, or paraboloid in longitudinal cross-section.

3. A jettisonable nosecone according to claim 1, wherein the nosecone has a trailing end including a peripheral convex bead (40) extending into a concave groove formed in said missile for connection therewith.

4. A missile having a jettisonable nosecone according to claim 3, wherein the convex bead on the nosecone engages in a raised collar (49) on the missile having the concave groove therein which runs in the circumferential direction thereof.

5. A missile according to claim 4, wherein the raised collar (49) is intermittently interrupted in the circumferential direction thereof.

6. A jettisonable nosecone according to claim 1, wherein at least one angled groove (42) for guidance of at least one pin (52) which is arranged on the missile is formed on the internal circumference of said nosecone for bracing the latter with respect to the missile.

7. A missile having a jettisonable nosecone according to claim 1.

* * * * *